US005195200A

United States Patent [19]

Leoutsakos

[11] Patent Number: 5,195,200

[45] Date of Patent: Mar. 23, 1993

[54] MANUAL SUPPORT APPARATUS ATTACHABLE TO A BEDFRAME

[76] Inventor: Thomas Leoutsakos, 19 Lafayette St., Randolph, Mass. 02368

[21] Appl. No.: 869,956

[22] Filed: Apr. 17, 1992

[51] Int. Cl.[5] ..... A47C 21/00

[52] U.S. Cl. ..... 5/662; 5/658; 5/503.1

[58] Field of Search ..... 5/503.1, 504.1, 507.1, 5/658, 662, 203, 305, 425

[56] References Cited

U.S. PATENT DOCUMENTS

| | | | |
|---|---|---|---|
| 1,797,847 | 3/1931 | Vandagriff | 5/507.1 X |
| 2,593,567 | 4/1952 | Keck | 5/503.1 X |
| 2,712,137 | 7/1955 | Hunter | 5/425 X |
| 3,863,282 | 2/1975 | Stillwell | 5/503.1 |
| 4,932,090 | 6/1990 | Johansson | 5/662 |

FOREIGN PATENT DOCUMENTS

| | | | |
|---|---|---|---|
| 2500743 | 9/1982 | France | 5/445 |
| 8202832 | 9/1982 | PCT Int'l Appl. | 5/445 |
| 1006956 | 10/1965 | United Kingdom | 5/425 |

*Primary Examiner*—Michael F. Trettel
*Attorney, Agent, or Firm*—Wolf, Greenfield & Sacks

[57] ABSTRACT

A manual support apparatus attachable to a bedframe for providing a secure and stable method for a user/patient to transfer into and out of bed independently, and enhance in-bed mobility. The manual support apparatus has two primary parts: a planar plate member and two tubular members. The plate member has outside edges for alignment with a bedframe's end and side rails. The tubular have internal bores for slidable receipt of a support tube, and is attached to the plate member by suitable means. The plate member is attached to the bedframe's end and side rail by suitable means.

In another embodiment of the invention, the manual support apparatus includes a planar plate member having outside edges and at least one support tube attached directly to the plate member. Alternatively, the manual support apparatus can have a unitary construction, including a planar plate portion having outside edges and at least one support tube portion.

10 Claims, 10 Drawing Sheets

MANUAL SUPPORT APPARATUS ATTACHABLE TO A BEDFRAME

BACKGROUND OF THE INVENTION

1. Field of the Invention

The present invention pertains to a manual support apparatus attachable to bedframes.

2. Description of the Prior Art

Transferring into and out of bed, as well as maneuvering in bed, may be a difficult process for some elderly or disabled persons.

Typical beds provide little or no additional manual support for these people, to assist them to gain their balance while transferring into or out of bed, or help them to adjust their in-bed posture. Particularly at risk of falling, are acute or chronic term patients alone in the home environment which require assistance maneuvering into and about the bed. These patients generally require a secure and stable method to transfer into and out of bed independently. A wheelchair user, for example, may find it difficult to transfer into and out of bed without assistance. It would be useful, therefore, to provide an apparatus for manual support.

While various home care and hospital beds have been available in the prior art, these beds and bedframes are generally expensive. In addition, these beds generally provide only full side rails which are raised to prevent patients from falling out of bed. These side rails do not assist the user in transferring into or out of bed. Furthermore, a patient may require additional support for only a temporary period and, therefore, would not require a new bed if an existing bed or bedframe can be enhanced.

It is therefore an object of this invention to provide an apparatus attachable to a bedframe which provides a secure and stable method to transfer into and out of bed independently, and improve in-bed mobility. A further object of the invention is to provide a manual support apparatus, which can be easily assembled and disassembled, as well as quickly attached and detached from any part of a bedframe without modification.

SUMMARY OF THE INVENTION

According to the present invention, a manual support apparatus attachable to a bedframe includes two primary parts: a planar plate member and at least one tubular member. The planar plate member has outside edges for alignment with a bedframe's end and/or side rails. The tubular member has an internal bore for slidable receipt of a support tube, and is attached to the plate member by suitable means. The plate member is attached to the bedframe's end and side rail by suitable means.

In another embodiment of the present invention, the manual support apparatus includes a planar plate member having outside edges and at least one support tube attached directly to the plate member.

In an alternative embodiment, the manual support apparatus is one-piece, including a planar plate portion having outside edges and at least one support tube portion.

Other objects and features of the present invention will become apparent from the following detailed description, when taken in connection with the accompanying drawings which disclose a preferred embodiment of the invention. It is to be understood that the drawings are designed for the purpose of illustration only and are not intended as a definition of the limits of the invention.

BRIEF DESCRIPTION OF THE DRAWINGS

The foregoing and other objects and advantages of the invention will be appreciated more fully from the following drawings in which.

DETAILED DESCRIPTION OF THE INVENTION

Figure 1A:
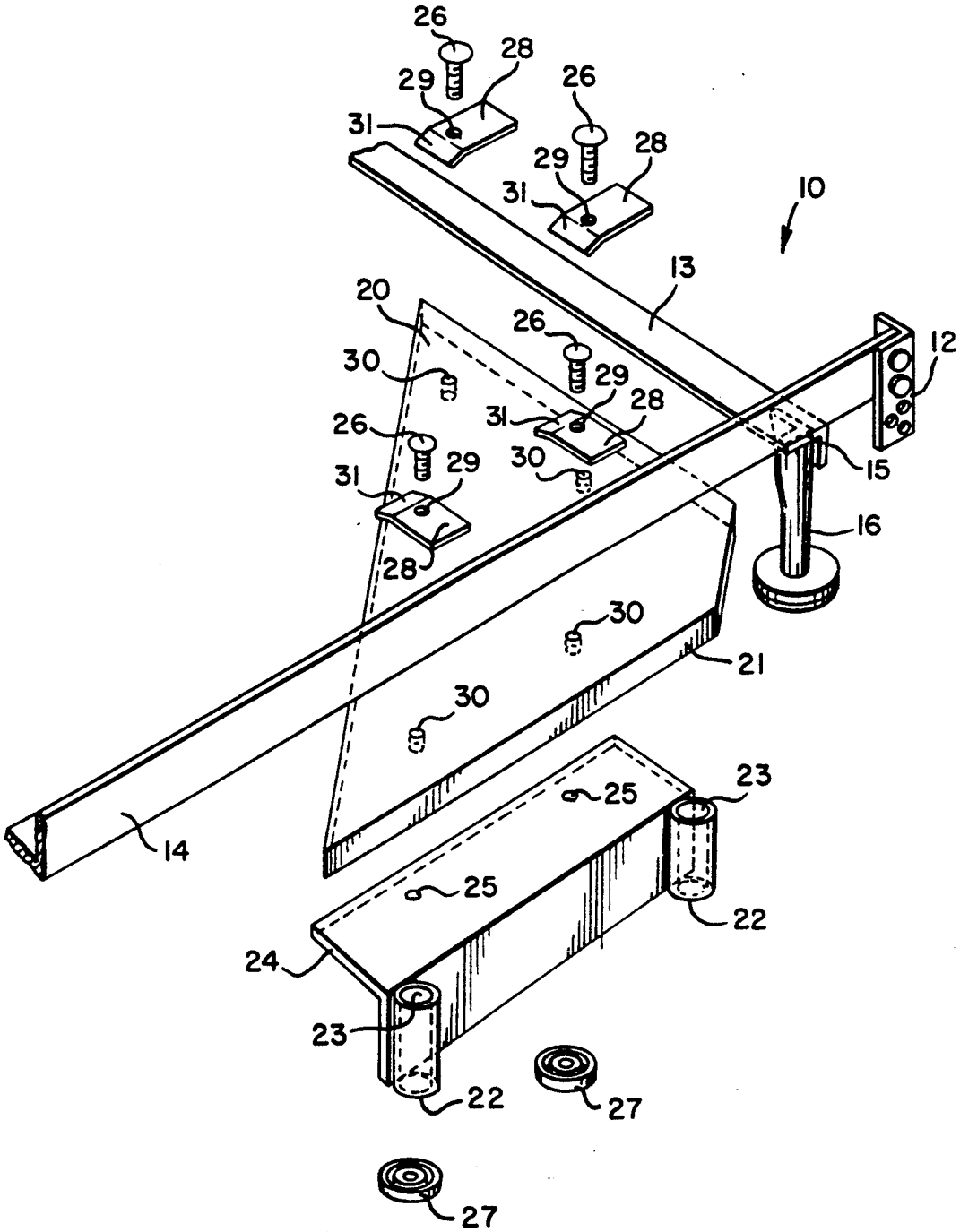
FIG. 1A is a perspective view of one embodiment of the present invention disassembled.
Figure 1B:
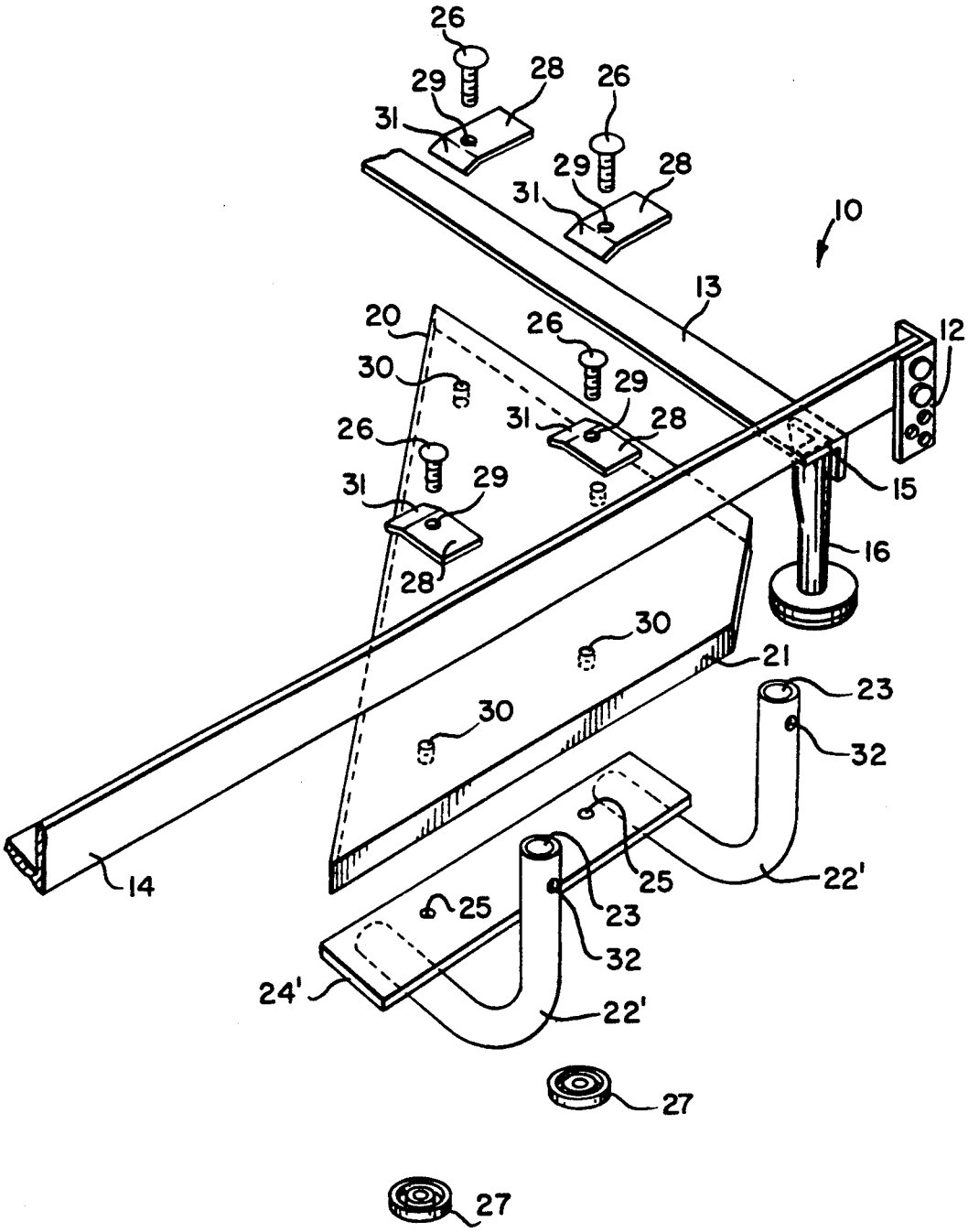
FIG. 1B is a perspective view of another embodiment of the present invention disassembled.

Turning now to the Figures, wherein like reference numerals indicate like elements, FIGS. 1A and 1B illustrate different embodiments of the manual support apparatus of the present invention. The manual support apparatus 10 may be easily attached to a typical bedframe 12, comprising a pair of end 13 and side rails 14 connected at a corner 15. Typically, a leg 16 or wheel (not shown) is positioned beneath each corner 15 in support of bedframe 12. The manual support apparatus 10 comprises a planar plate member 20 having outside edges 21, and at least one tubular member 22 (22' in FIG. 1B) having an internal bore 23 for slidable receipt of a support tube (not shown).

FIG. 1A shows two tubular members 22 attached to opposite ends of a support brace 24 having two holes 25 which allow brace 24 to be attached to plate 20.

FIG. 1B shows two tubular members 22' attached to opposite ends of a support brace 24' having two holes 25 which allow brace 24' to be attached to plate 20.

Plate member 20 is attached to the end 13 and side rail 14 of bedframe 12 with clip members 28, which are secured by bolts 26 mated with fittings 27. Bolts 26 pass through adequately sized holes 29 in clip members 28, through plate holes 30 and brace holes 25. After passing through the holes in the stacked members, the bolts 26 are threadably mated with fittings 27, which are typically adjustable by hand, providing a simple method to attach and detach manual support apparatus 10 without tools. Clip 28 includes a beveled end 31 which provides a slot (not shown) in which the end 13 and side rails 14 are grasped.

Planar plate 20 is typically made from a lightweight, rigid material such as plastic, fiberglass, wood or metal. Preferably, planar plate 20 is constructed of a plastic material such as high density polyethylene or polyvinylchloride; more preferably, planar plate 20 is made from a composite wood material, such as standard plywood, due to its light weight, strength and relatively inexpensive price. Most preferably, planar plate 20 is made from a metal material, such as stainless steel or aluminum, due to its strength and workability. Planar plate 20 is typically shaped such that at least one edge 21 is aligned with the end 13 and side rails 14 of bedframe 12. Preferably, planar plate 20 is triangular- or rectangular-shaped to provide a flush fit with end 13 and side rails 14, and corner 15 of bedframe 12. Most preferably, planar plate 20 is trapezoid shaped, to provide a notch which allows for the bedframe's legs 16 (or wheels) to project downward. It should be noted, however, that planar plate 20 may be any shape such that outside edges 21 align with bedframe 12. Planar plate 20 is preferably removably attached to the bottom (underside) of bedframe 12 to allow a mattress and/or box spring (not shown) to be placed on top of bedframe 12, within end 13 and side rails 14.

Tubular members 22 (22') are typically made from a rigid, durable material such as a hard plastic or metal. Preferably, tubular members 22 (22') are made from steel pipe; more preferably, tubular members 22 (22') are made from aluminum pipe due to its light weight. Tubular members 22 (22') have a central aperture, or bore 23, with a tubular axis. Tubular members 22 (22') and the support tube (not shown) have complimentary cross sectional configurations, allowing the support tube to be coaxially slidable through the bore 23 of the tubular member. The internal diameter of bore 23, and the outside diameter of the support tube, is wide enough to provide support and narrow enough to be easily grasped by a user/patient. Typically, the diameters are between about ½ inch to about 3 inches. Preferably, the diameters are between about ¾ to about 1 inch.

Tubular members 22 (22') are typically secured to a support brace 24 (24') prior to being attached to planar plate 20 and bedframe 12. Tubular members 22 (22') may be secured to support brace 24 (24') in any manner, such as screw-fit, or snap fit. Preferably, tubular members 22 (22') are welded to support brace 24 (24').

Support brace 24 {24') typically includes holes 25 to allow bolts 26 to pass through to, and be mated with fittings 27 on the underside of the brace. In this manner, brace 24 (24'), including tubular members 22 (22'), may be removably attached to planar plate 20. Alternatively, brace 24 (24') and tubular members 22 (22') may affixed, or welded, to the underside of plate member 20. Another approach involves the brace 24 (24') and tubular members 22 (22') being independently removably attached to plate member 20.

As noted, plate member 20 and support brace 24 (24') may be removably attached to bedframe 12 by means of bolt 26 and fitting 27. Prior to passing through plate member 20, bolt 26 passes through hole 29 and holds down clip 28. Clip 28 includes a beveled end 31, positioned opposite end 13 or side rail 14. In an alternative embodiment, clip 28 may be integral with the surface, or formed in the edges 21 of planar plate 20.

Figure 2A:
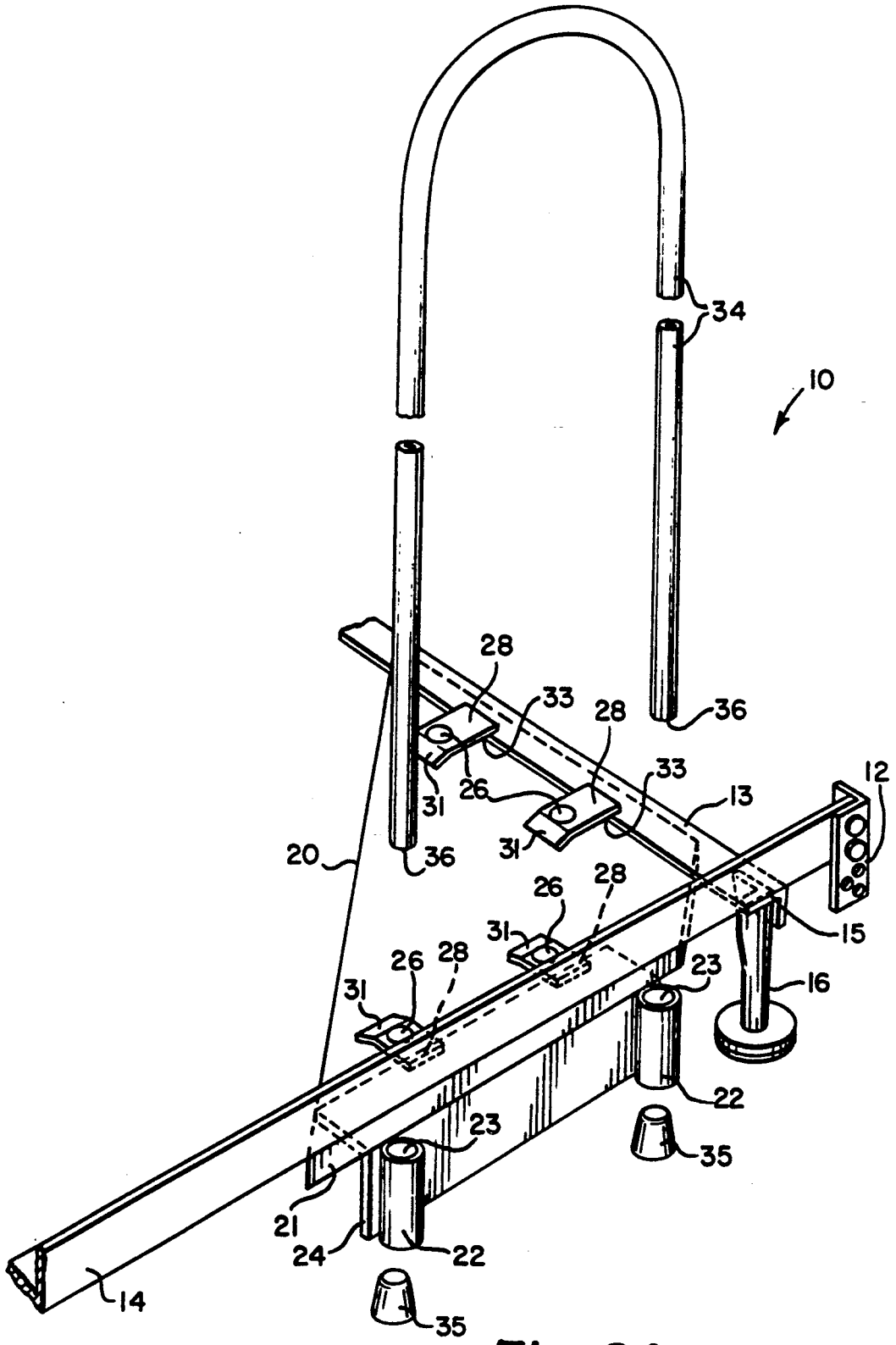
FIG. 2A is a perspective view of the embodiment of the present invention shown in FIG. 1A assembled.
Figure 2B:
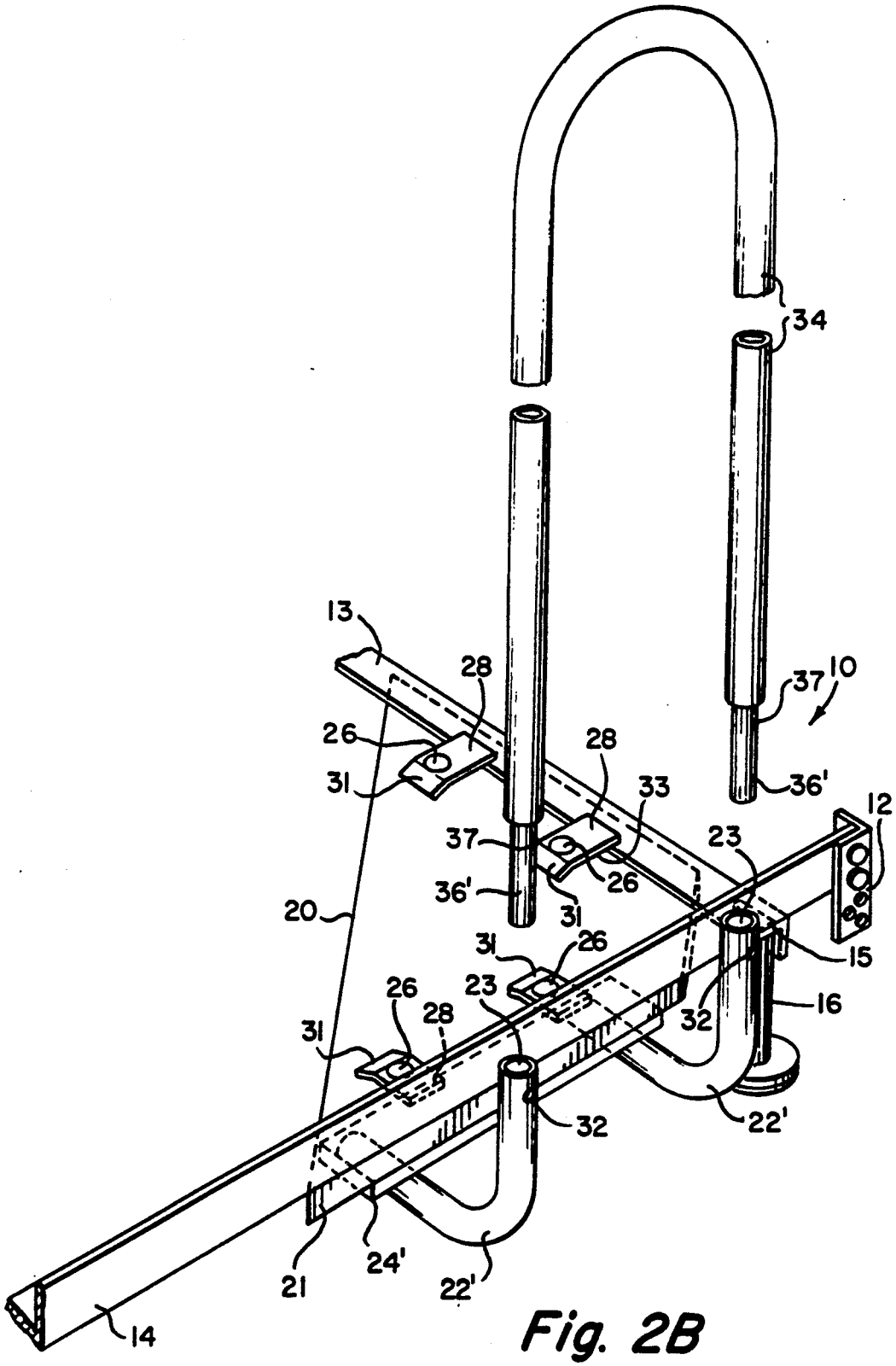
FIG. 2B is a perspective view of the embodiment of the present invention shown in FIG. 1B assembled.

Turning now to FIGS. 2A and 2B, embodiments of bedframe support apparatus 10 illustrated in FIGS. 1A and 1B respectively, are assembled and attached to bedframe 12.

FIGS. 2A and 2B also show a support tube 34, positioned over bores 23 of tubular members 22 (22'). Although support tube 34 is shown in a typical inverted U-shape, other shapes, and various sizes, as required by each user/patient are possible. Support tube 34 is typically made from a rigid, durable material such as a hard plastic or metal. Preferably, support tube 34 is made from steel pipe; more preferably, tubular members 22 (22') are made from aluminum pipe due to its light weight. Most preferably, support tube 34 is made of a similar material as tubular members 22 (22').

Once support tube 34 passes through bore 23 of tubular members 22, as shown in FIG. 2A, ends 36 are covered with caps 35. Caps 35 are typically made from a rubber-like material and are provided to protect ends 36 of support tube 34, and the floor beneath bedframe 12. In addition, caps 35 add support and traction to the manual support apparatus 10.

FIG. 2B shows alternative support tube 34 having a reduced cross-sectional diameter at end 36' which fit into bores 23 of tubular members 22'. The ends 36' of support tube 34 include projections 37 which are spring-fit, and are pressed into support tube 34 while ends 36' are placed into bores 23 of tubular members 22'. The projections 37 provide a locking mechanism as they are snap-fit into holes 32 when support tube 34 is placed into bores 23. In addition, projections 37 provide an easy means to interchange various shapes and sizes of support tubes 34.

Clips 28 attach the manual support apparatus 10 to bedframe 12. The beveled ends 31 of clips 28, opposite end 13 and side rail 14, create slots 33 in which the rails of bedframe 12 are secured.

Figure 3A:
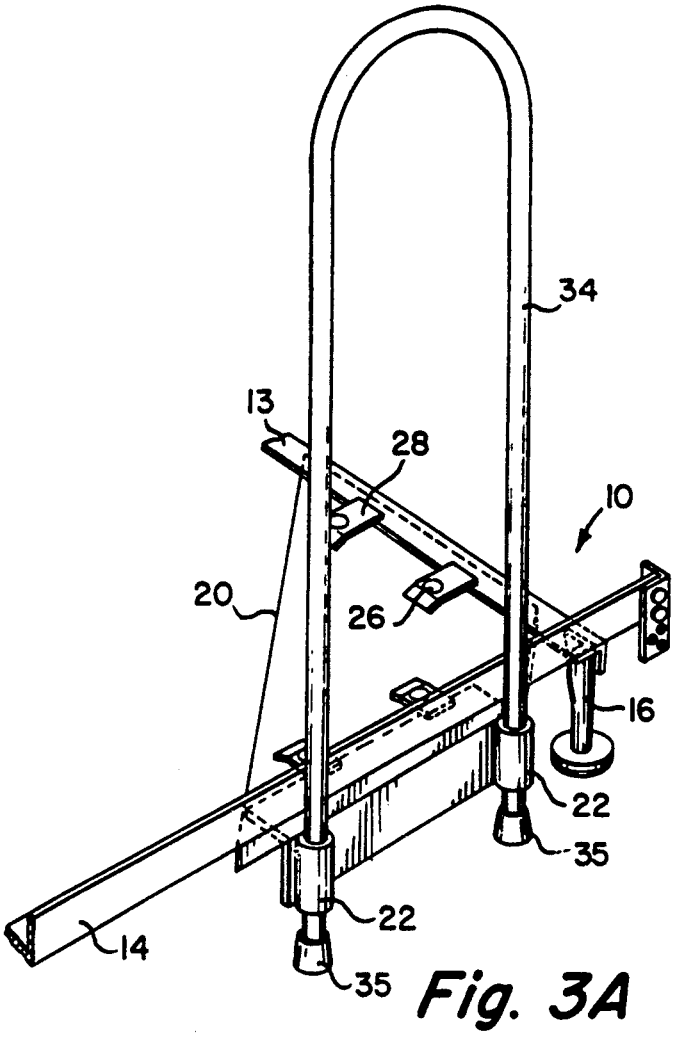
FIG. 3A is a perspective view of the embodiment of the present invention shown in FIG. 2A.

FIG. 3A shows manual support apparatus 10 fully assembled, and attached to bedframe 12, with support tube 34 placed through support tubes 22. Support tube 34 provides assistance to a user/patient to transfer into and out of bed, as well as increasing in-bed mobility. It should be noted that the top portion of support tube 34 may be knurled and/or padded to provide added user comfort and a more secure grip.

Figure 3B:
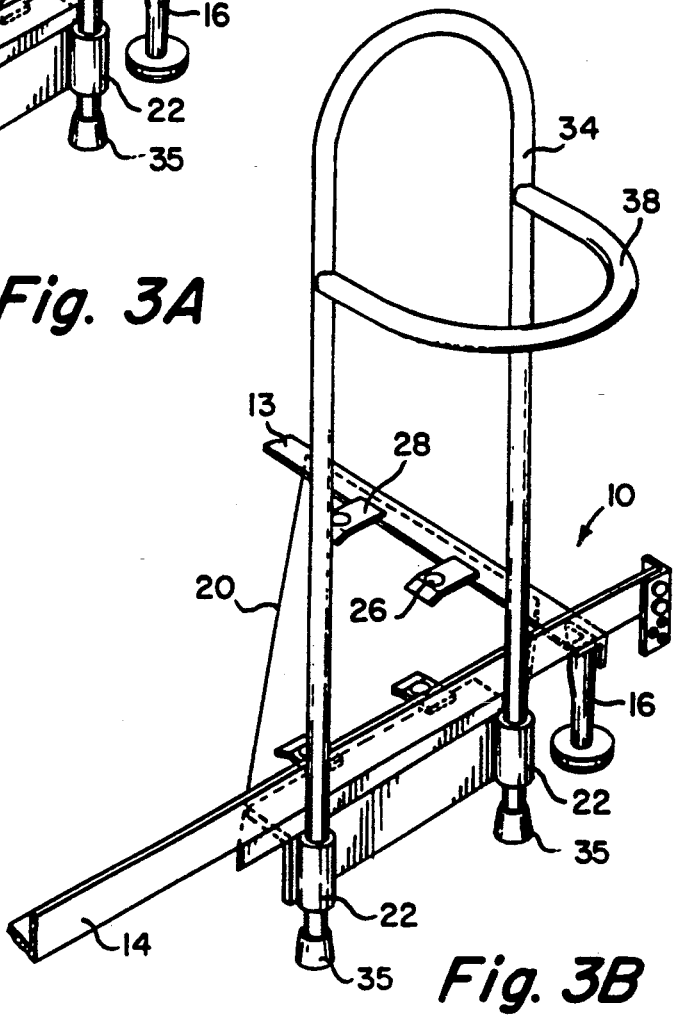
FIG. 3B is a perspective view of the embodiment of the present invention shown in FIG. 2A with an alternative support tube member.
Figure 3C:
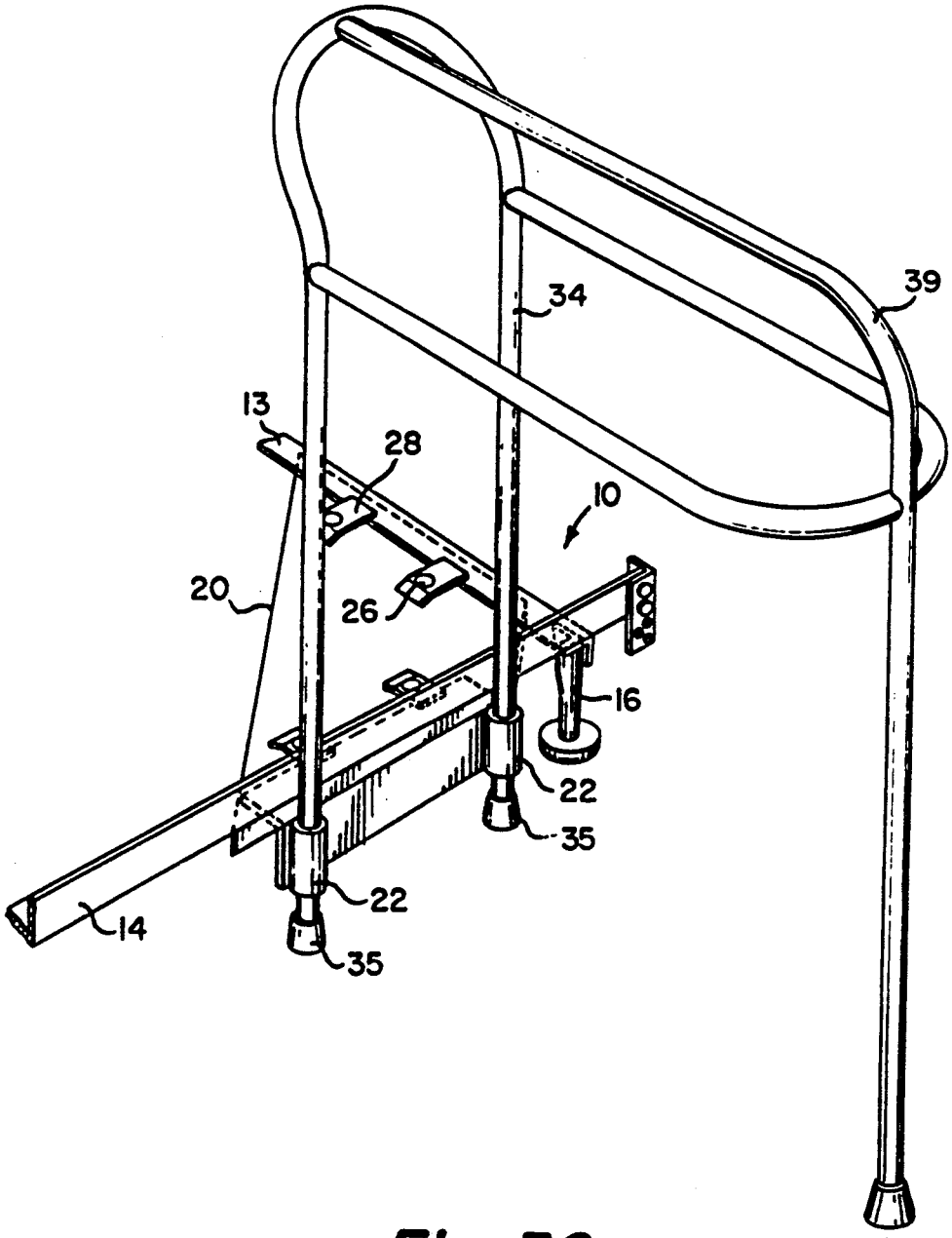
FIG. 3C is a perspective view of the embodiment of the present invention shown in FIG. 2A with an alternative support tube member.

FIGS. 3B and 3C illustrate alternative embodiments of support tube 34. FIG. 3B shows a handle 38 projecting from support tube 34, to provide additional support for the user/patient when transferring into or out of, or standing near the bed. Similarly, FIG. 3C shows a handle extension 39 attached to an angled top support tube 34, which is best suited for wheelchair patients.

Figure 4A:
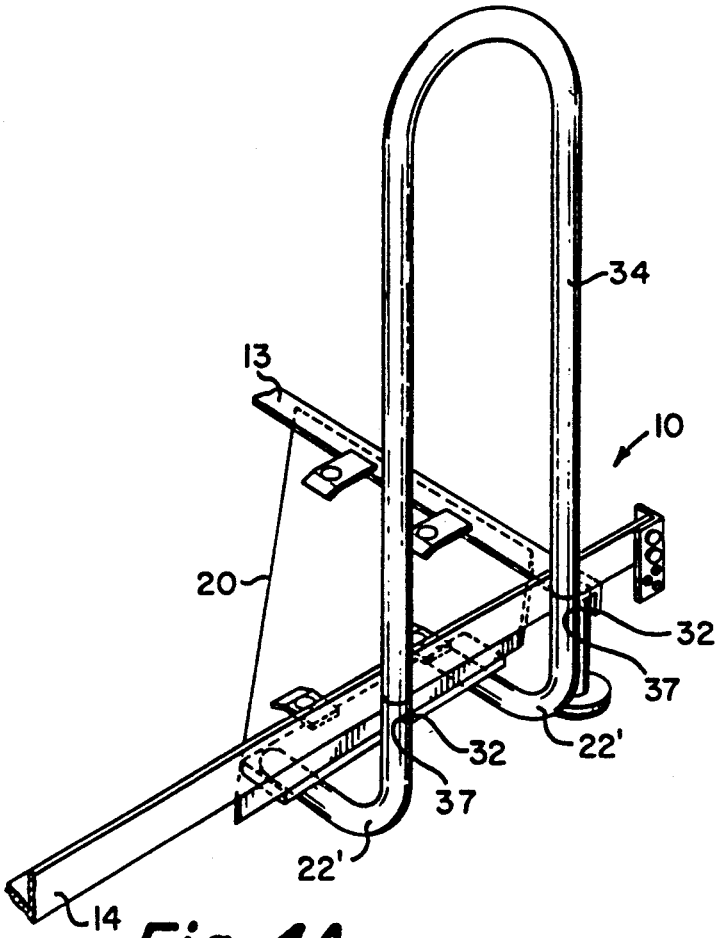
FIG. 4A is a perspective view of the embodiment of the present invention shown in FIG. 2B.
Figure 4B:
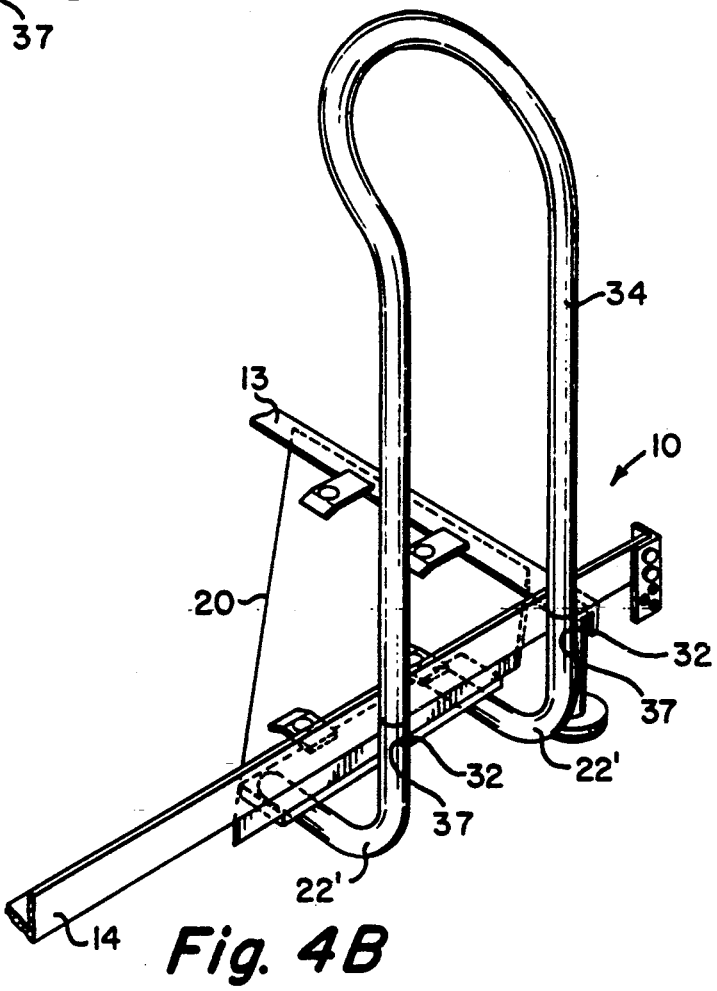
FIG. 4B is a perspective view of the embodiment of the present invention shown in FIG. 2B with an alternative support tube member.

FIGS. 4A and 4B illustrate manual support apparatus 10, shown in FIG. 2B, fully assembled and attached to bedframe 12. FIG. 4A shows support tube 34 snap-fit within bores 23 of tubular members 22', as projections 37 are fit through holes 32. FIG. 4B shows an alternative shape of support tube 34, wherein the top portion is angled toward the bed to provide the user/patient with closer access to facilitate movement about the bed.

It should be noted that there are many other size and/or shape variations of support tubes which can be utilized with manual support apparatus. A single support tube 34 may be used, for example, as an intravenous fluid holding pole or as part of a traction unit. Multiple support tubes may be used in combination, for example, as a food tray or phone table with an inverted U shaped support tube. It should also be noted that manual support apparatus 10 may be attached to any part of bedframe 12, to address any patient's particular needs.

Figure 5:
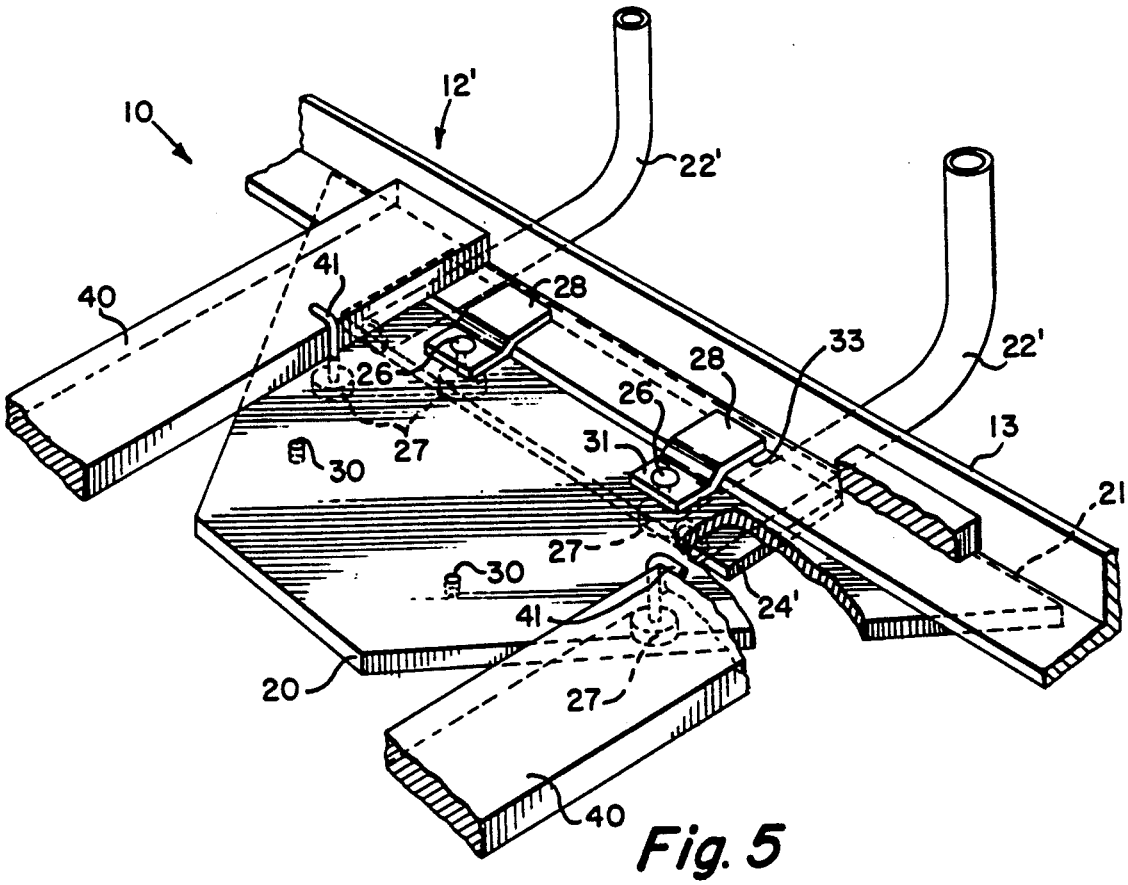
FIG. 5 is a perspective view of an alternative application of the present invention.

FIG. 5 illustrates how manual support apparatus 10 can also be attached to bedframes having only side rails connected at the ends to head and foot boards (not shown, instead of end rails). Manual support apparatus 10 is attached by aligning an edge 21 of plate member 20 with side rail 13. Typically, in bedframes of this type, support slats 40 are used to support a box spring and mattress. Support slats 40 are typically laid across bedframe 12' horizontally so that the ends of slats 40 rest on side rails 13. Tubular members 22' are attached to support brace 24', which is attached to plate member 20 by bolts 26 and fittings 27. Bolts 26 pass through clips 28, which have beveled ends 31 creating slots 33 for side rails 13 to be fit. Manual support apparatus 10 is also attached to bedframe 12' with L shaped bolts 41, which are positioned adjacent to support slats 40. The top portions of L-shaped bolts 41 extend over slats 40, while the bottom portion of bolts 41 are threadably mated with fittings 27 on the underside of plate member 20, holding slats 40 and apparatus 10 in place.

Figure 6:
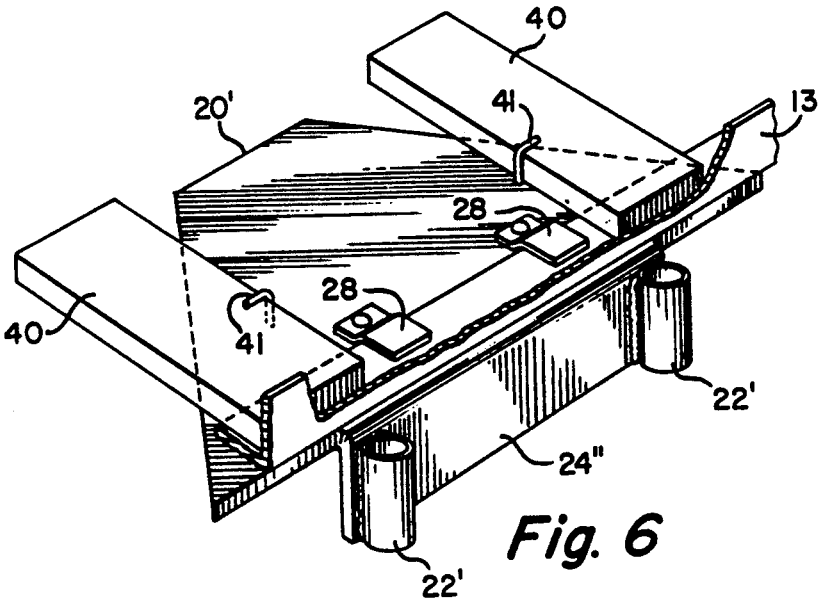
FIG. 6 is a perspective view of an alternative embodiment of the present invention.

FIG. 6 shows another embodiment of manual support apparatus 10, wherein plate member 20' is integral with support brace 24''. In this embodiment, a portion of plate member 20' is turned at a 90 degree angle. Therefore, when tubular members 22 are attached to support brace 24'', they are perpendicular to the plane of plate member 20'. Although FIG. 6 shows an alternative embodiment of manual support apparatus 10 attached to side rail 13 (as in FIG. 5), this embodiment can be applied in the manner described and shown in FIGS. 2A and 2B.

Figure 7:
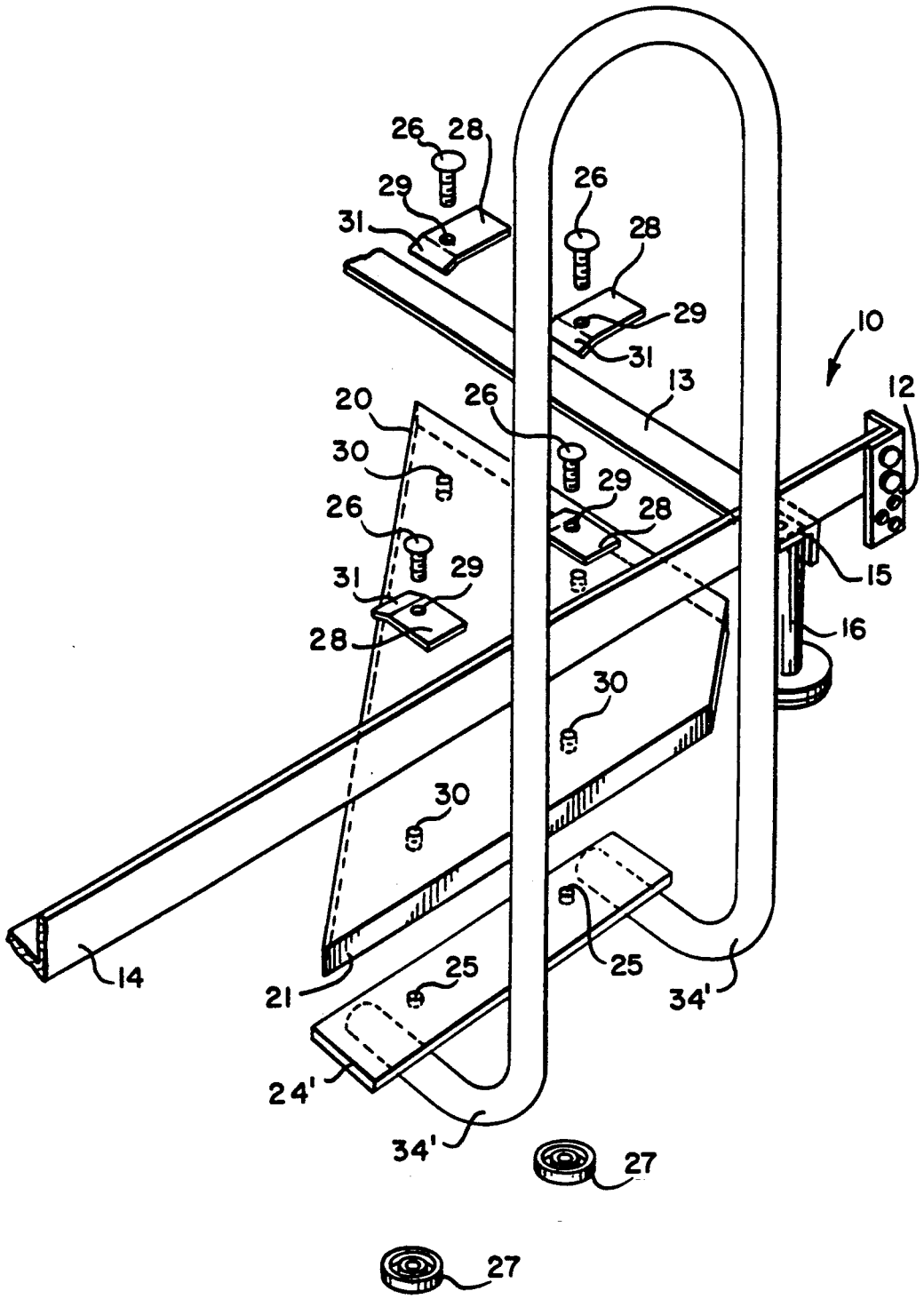
FIG. 7 is a perspective view of an alternative embodiment of the present invention disassembled, wherein the support tube can be attached directly to the planar plate member.

FIG. 7 illustrates an alternative embodiment of manual support apparatus 10. The manual support apparatus 10 may be more easily assembled and attached to bedframe 12. The manual support apparatus 10 comprises planar plate 20 having outside edges 21, and at least one support tube 34' which can be attached with support brace 24'.

Alternative support tube 34' is equivalent to incorporating the tubular members and support tube of the embodiment shown in FIGS. 1B and 2B, and is preferred when the user/patient require only one type of support tube 34'.

Figure 8:
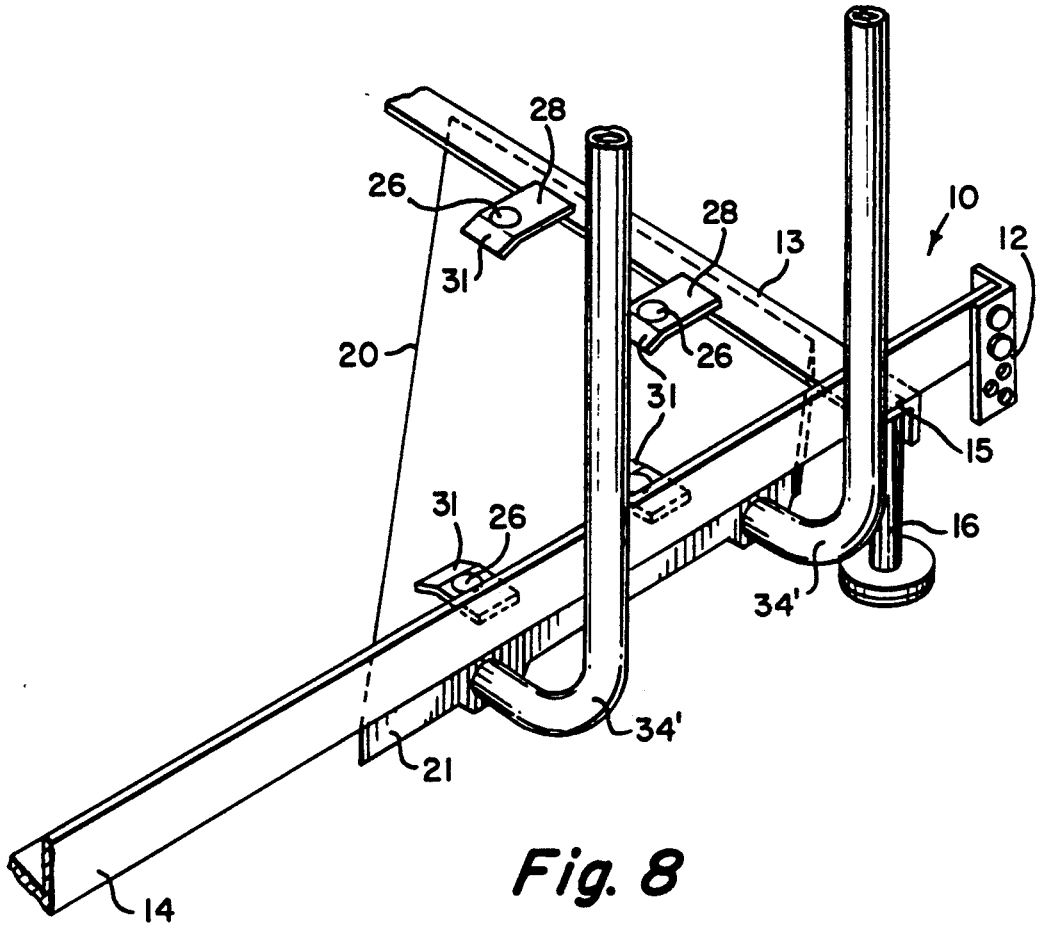
FIG. 8 is a perspective view of an alternative embodiment of the present invention, including a unitary construction, attached to a bedframe.

FIG. 8 illustrates another embodiment of manual support apparatus 10, which has a unitary construction and includes a planar plate portion 20'' having outside edges 21, and at least one support tube portion 34'.

Although FIG. 8 shows support tube portions 34' projecting from edge 21, it is understood by those skilled in the art that other one piece configurations are possible. For example, support tube portion 34' can protrude from the underside of planar plate 20''; or manual support apparatus 10 can consist of only support tube 34', configured such that it may be attached to end 13 and/or side rails 14 of bedframe 12.

The foregoing detailed description has been given for clearness of understanding only, and unnecessary limitations are not to be construed therefrom. The invention is not to be limited to the exact details shown and described since obvious modifications will occur to those skilled in the art, and any departure from the description herein that conforms to the present invention is intended to be included within the scope of the claims.

What is claimed is:

1. A manual support apparatus attachable to a bedframe comprising:

a planar plate member having outside edges;

two tubular members having internal bores for slidable receipt of a support tube;

a first means to attach said tubular members to said plate member; and a second means to attach said plate member to said bedframe.

2. The manual support apparatus of claim 1 wherein the planar plate member is a rigid material, said plate being shaped so that at least one edge is aligned with said bedframe.

3. The manual support apparatus of claim 1 wherein the planar plate member is removably attached to the bottom of said bedframe.

4. The manual support apparatus of claim 1 wherein the support tube and the tubular member have complementary cross-sectional configurations such that the support tube is coaxially slidable through the bore of the tubular member.

5. The manual support apparatus of claim 1 wherein the tubular member is substantially perpendicular to the plane of said plate member.

6. The manual support apparatus of claim 1 wherein the first means to attach Said tubular member to said plate member is part of said plate member.

7. The manual support apparatus of claim 1 wherein the first means to attach said tubular member to said plate member is detachable.

8. The manual support apparatus of claim 1 wherein the second means to attach said plate member to said bedframe is part of said plate member.

9. The manual support apparatus of claim 1 wherein the second means to attach said plate member to said bedframe is detachable.

10. A manual support apparatus attachable to a bedframe comprising:

a planar plate member having outside edges;

a support tube having two legs;

two tubular members having internal bores for slidable receipt of said support tube;

a first means to attach said tubular members to said plate member; and a second means to attach said plate member to said bedframe.

* * * * *